US005642593A

United States Patent [19]

Shieh

[11] Patent Number: 5,642,593

[45] Date of Patent: Jul. 1, 1997

[54] KNOCKDOWN AND REASSEMBLE OFFICE PARTITION

[76] Inventor: Steven J. Shieh, 60 Commerce Pl., Hicksville, N.Y. 11801

[21] Appl. No.: 587,958

[22] Filed: Jan. 17, 1996

[51] Int. Cl.[6] ..... E04B 2/82

[52] U.S. Cl. ..... 52/239; 52/220.7; 52/243; 52/481.1; 52/489.1; 160/130; 160/135

[58] Field of Search ..... 52/239, 243, 220.7, 52/481.2, 489.1; 160/130, 135

[56] References Cited

U.S. PATENT DOCUMENTS

| | | | |
|---|---|---|---|
| Re. 32,890 | 3/1989 | DeFouw et al. . | |
| 3,767,237 | 10/1973 | Suchowski . | |
| 3,831,330 | 8/1974 | Tacke et al. | 52/220.7 |
| 4,100,709 | 7/1978 | Good . | |
| 4,123,879 | 11/1978 | Blodee et al. . | |
| 4,570,406 | 2/1986 | DiFazio . | |
| 4,601,137 | 7/1986 | Bates | 52/220.7 X |
| 4,682,457 | 7/1987 | Spencer | 52/239 |
| 4,685,255 | 8/1987 | Kelley . | |
| 4,716,699 | 1/1988 | Crossman et al. | 52/239 |
| 4,832,152 | 5/1989 | Schuelke et al. . | |
| 4,876,835 | 10/1989 | Kelley et al. . | |
| 4,949,519 | 8/1990 | Jeffers | 52/239 |
| 4,956,953 | 9/1990 | Bates | 52/239 |
| 5,054,255 | 10/1991 | Maninfior | 52/239 |
| 5,059,218 | 10/1991 | Pick . | |
| 5,062,246 | 11/1991 | Sykes | 52/220.7 X |
| 5,117,599 | 6/1992 | Voss . | |
| 5,138,814 | 8/1992 | Giles et al. . | |
| 5,177,917 | 1/1993 | del Castillo Von Haucke | 52/220.7 |
| 5,207,037 | 5/1993 | Giles et al. | 52/220.7 X |
| 5,209,035 | 5/1993 | Hodges et al. . | |
| 5,214,890 | 6/1993 | Levitan et al. | 52/220.7 |
| 5,214,893 | 6/1993 | Clement . | |
| 5,297,891 | 3/1994 | Rosa . | |
| 5,431,211 | 7/1995 | Guillemet . | |

*Primary Examiner*—Wynn E. Wood

[57] ABSTRACT

A knockdown and reassemble office partition (14) which comprises a pair of side frame members (16), a top frame member (18), a bottom frame member (20) and an intermediate frame member (22). A facility (24) is for securing in a removable manner each of the side frame members (16) vertically to one end of the top frame member (18), the bottom frame member (20) and the intermediate frame member (22) which are positioned horizontally, so as to form a rigid structural framework (26).

1 Claim, 7 Drawing Sheets

74
72
44
40
82
58
18
42
14
60
24
44
46
22
30
26
28
66
46
16
68
70
20
48
16
84
34
38
32
82

Fig. 3
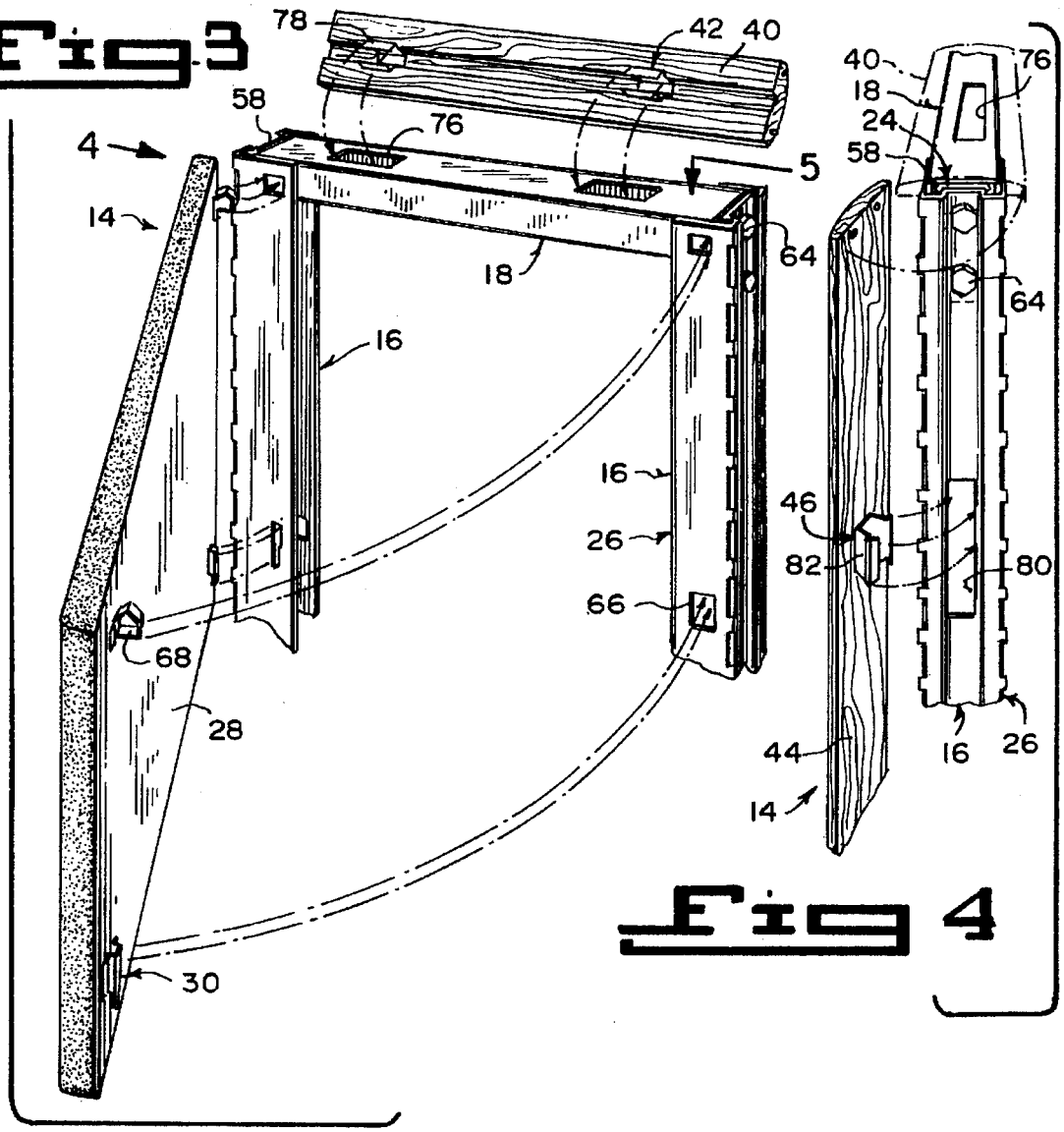
Fig 4
Fig. 5
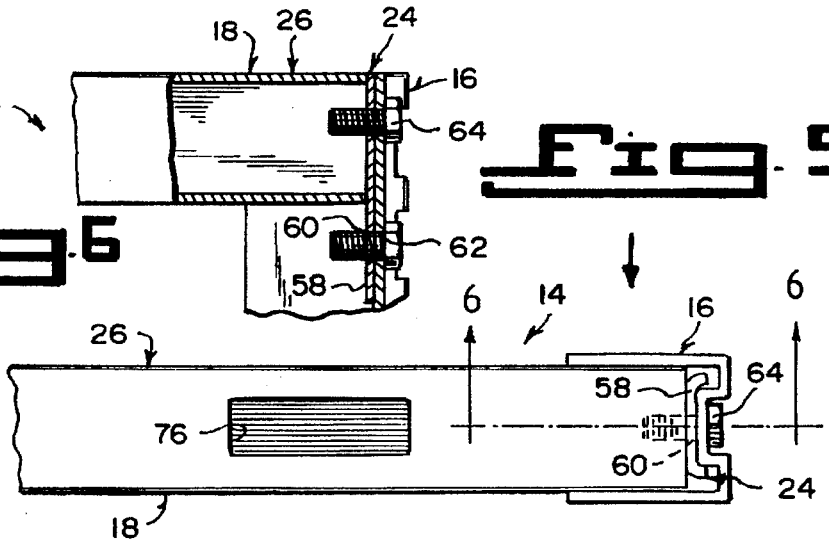
Fig. 6

KNOCKDOWN AND REASSEMBLE OFFICE PARTITION

BACKGROUND OF THE INVENTION

1. Field of the Invention

The instant invention relates generally to construction framing systems and more specifically it relates to a knock-down and reassemble office partition.

2. Description of the Prior Art

Numerous construction framing systems have been provided in prior art. For example, U.S. Pat. Nos. 3,767,237 to Suchowski; 4,100,709 to Good; 4,123,879 to Blodee et al.; 4,570,406 to DiFazio; 4,685,255 to Kelley; 4,876,835 to Kelley et al.; 5,059,218 to Pick; 5,117,599 to Voss; 5,138,814 to Giles et al.; 5,209,035 to Hodges et al.; 5,214,893 to Clement; 5,297,891 to Rosa and 5,431,211 to Guillemet all are illustrative of such prior art. While these units may be suitable for the particular purpose to which they address, they would not be as suitable for the purposes of the present invention as heretofore described.

SUCHOWSKI, BERNARD

MITER FRAME CORNER CONSTRUCTION

U.S. Pat. No. 3,767,237

A miter corner construction for multiple-panelled enclosures, such as aquarium tanks, comprising a frame corner formed of three mutually perpendicular members and a three-branched connector clip positioned within the corner. Each frame member comprises two longitudinal walls in right-angled relation, each of the walls having a longitudinal rib, the pair of ribs forming therebetween a cavity within which is disposed one of the clip branches. The lateral edge of each clip branch is notched, a portion of the rib extending into the adjacent notched portion, other portions of the rib being in overlying engagement with the clip branch, whereby the three frame members are held against longitudinal and transverse movement relative to each other and the clip. In the method of making the construction, the miter end portions of the three frame members are first slipped over the respective branches of the clip until the members are in mated engagement. Then, by a single swedging action, portions of the ribs are swedged into adjacent notched portions of the respective clip branches, and at the same time other selected portions of the ribs are wedged into overlapping engagement with the respective adjacent clip branches.

GOOD, WAYNE W.

FRAME CONSTRUCTION FOR A DIVIDER WALL

U.S. Pat. No. 4,100,709

A free-standing, prefabricated, know down, readily assembled and disassembled, relocatable vertical wall or space divider. Such wall dividers are useful to partitioning buildings and/or office complexes. The wall is made up of a plurality of individualized and decorative flush panel units which are interchangeable and which are adapted to be readily inserted within quadrilateral openings delineated by a novel wall frame and locked into place by hidden spline members that are mounted in the wall frame for translatory movement. The wall frame is fabricated in a novel assemblage of unique components which can present either a metallic or wooden exterior finish surface. The configuration of the wall frame components provides for lateral walls to extend outwardly not only at modular locations but also from any other desired location by use of novel adapters. The panels may be removed, redecorated and replaced as needed. Shelving or other appurtenances are attachable to the hidden spline members. The entire wall panel and/or divider is readily relocatable when it is desired to re-arrange, enlarge or change a given floor space.

BLODEE, LEIF

KNAPP, ROBERT L.

OPPENHUIZEN, SIMON W.

PANEL WALL SYSTEMS WITH MODULAR COMPONENT BUILD-UP

U.S. Pat. No. 4,123,879

An improved panel wall system is disclosed with means for interconnecting the panels in any desired angular relationship while providing a sight barrier through the joint. As many of the panels may be connected as are desired; and they may be placed in any desired configuration. Each panel includes an insert assembly to provide its exterior face; and these may be removed and changed, if desired. A full line of shelving and cabinets may be assembled to the panels with a limited number of interchangeable components. The cabinets include a flipper door which will not rack when opened or closed, and which slides beneath the top of the cabinet in the open position, yet has its edges flush with the top and bottom of the cabinet in the closed position.

DiFAZIO, JOSEPH

SCREEN FRAME CORNER CONNECTOR KEY

U.S. Pat. No. 4,570,406

A hollow, thin wall, generally rectangular shaped corner connector key forms the frame corner and connects together the adjacent ends of tubular screen frame members. The legs of the L-shaped key form a hollow box-like corner portion, against which the frame ends are abutted. Integral leg extensions telescopically fit into and are frictionally locked against the interior wall surfaces of the frame members. The hollow, tubular cross-section shape of the key, whose box-like corner portion corresponds to the cross-sectional shape of the exterior of the frame members, and whose leg extensions correspond to the interior cross-section of the frame members, coupled with the frame member abutments and the frictional locking, substantially rigidifies the frame corner and resists out-of-plane twisting or bending of the frame.

KELLEY, JAMES O.

WORK SPACE MANAGEMENT SYSTEM

U.S. Pat. No. 4,685,255

A work space management system for dividing a room into separate work areas comprising a wall system having a rigid framework formed of rigid rectangular frames rigidly joined together at the edges thereof to form at least one work area, wire management elements secured to the frames for communication and power wiring and a plurality of modular panels removably hanging on the frames. At least some of the wire management elements are secured to the bottom or baseline of the frames and at least some of the wire management elements are removably secured to a waistline or mid-portion of at least some of the frames. In some cases, the frames only extend to a waist height and in other cases, the frames extend to a full panel height. The panels are sized to fit between the waistline wire management elements and the baseline wire management elements to substantially cover the frames therebetween. The work management system provides an architectural wall system with flexibility for interchangeable panels for different decorative effects as well as functional features. The panels can be fabric or vinyl covered, or can comprise acoustical panels, window panels, work-in-process panel rails or lighting panels.

KELLEY, JAMES O.

STUMF, WILLIAM E.

FRIEDMAN, FRANK A.

WORK SPACE MANAGEMENT SYSTEM

U.S. Pat. No. 4,876,835

A work space management system for dividing a space into separate work areas comprising a wall system having a rigid framework formed of rigid rectangular frames rigidly joined together at the edges thereof to form at least one work area, wire management elements secured to the frames for communication and power wiring and a plurality of selectively relocatable modular tiles removably hanging on the frames. Some of the wire management elements are secured to the bottom or baseline of the frames and some of the wire management elements are removably secured to a waistline or mid-portion of at least some of the frames. The frames can extend to a waist height, a seated height, to a standing or full floor to ceiling height in a modular stepped fashion. Decorative and functional modular tiles are sized to fit on the frames to substantially cover the frames, and are independently and removably mounted thereto. The tiles are of equal height and of variable modular width to cover the frames. Further, the tiles are easily mounted to and removed from the frames so that the tiles are relocatable and interchangeable with one another within the same frame and among the different frames for ease of customizing work stations within the system. The work space management system provides an architectural wall partition system with flexibility for interchangeable tile panels for different decorative effects and various functional features. The tiles can be painted, fabric, or vinyl covered, or can comprise acoustical tiles, window tiles, work-in-process rail tiles, lighting tiles, tackable tiles, marker tiles, data display tiles, display tiles, shelf tiles, open pass-through tiles, wire management tiles, mail tiles, storage tiles, heater tiles, and cooling and air circulation tiles.

PICK, WILLIAM

CONSTRUCTION FOR SUPPORTING A FLEXIBLE SHEET

U.S. Pat. No. 5,059,218

A construction for supporting a flexible sheet is disclosed which includes a U-shaped channel having opposing flanges that are adapted to receive a complimentary spline member for frictionally engaging a flexible sheet, such as window screen, between a surface of the spline member and an adjacent inner surface of one flange of the U-shaped channel. The structure has several practical applications including the construction of window screens, electrostatic air filters of the charged media type, storm windows of plastic film and the like. An improved construction for an electrostatic air filter of the charged media type is also disclosed.

VOSS, ROY N.

PANEL CONNECTOR ARRANGEMENT FOR OFFICE FURNITURE DEMOUNTABLE WALL PANEL SPACE DIVIDER SYSTEMS

U.S. Pat. No. 5,117,599

A panel connector arrangement for office furniture demountable wall panel space divider systems. The individual panels are of the familiar quadrilateral configuration and include at each of the panel side edges a rectilinear side frame member in the form of a side channel extending continuously between the upper and lower ends of the panel and defining a planar web disposed between a pair of side frame member planar shoulders. The connector arrangement involved being for use in removably joining to a free standing or fixed upright such panel as unattached such panel, and free of any post or other standard between such panels that are in coplanar relation. The connector arrangement involved comprising a clamp device having a pair of relatively movable bodies forming opposed clamping heads shaped and position relative to indexing apertures formed in the upper ends of the side frame members of all the panels to be so secured. A discrete bottom seating hook, and associated indexing apertures formed in such panel side frame members adjacent the lower end of same for seating the free unattached panel on the free standing or fixed panel and swinging the unattached panel so that its side frame shoulders seat against the side frame shoulders of the fixed panel. The clamp device heads being formed for disposing the clamp device heads in clamping relation to the panel side frames involved longitudinally thereof. Such panel side frames are anchored to each other, and the side frame of the panel being mounted ins clamped against the seating hook.

GILES, CHRISTOPHER D.

McNEAL, STEVEN E.

WALL PARTITION UNITS

U.S. Pat. No. 5,138,814

The partition wall units include panels with mitered tubular frame strips, posts, raceways which also can be adapted for baseboards, and covering edge strips. Most of these units include a groove along an outer edge into which are removable mounted interlocking or interhooking key members having uniform C-shaped cross-sections. These C-shaped cross-section key members on adjacent edges slideably engage each other to form cylindrical apertures between the two interhooked C's. Self-tapping screws are then screwed into these cylindrical apertures near the ends of the adjacent strip for locking the two units together. The substantially rectangular tubular frame strips around the panels have mitered joints which are connected by a pair of longitudinally complementary angle blocks with complementary grooves along their legs between their abutting surfaces. Self-tapping screws are screwed into these leg grooves to wedge the blocks apart to frictionally engage the inner surfaces of the tubular frame strips at their mitered corners to hold the joints together. The raceway units have a uniform I-shaped cross-section in which at least one end of the "I" is provided with a C-shaped key member, and the outer edges of the "I" are provided with grooves for hinging and snapping longitudinal cover strips which form channels into which conduits may be placed. Also, the webs of the "I" may be provided with apertures for electrical outlets and for mounting flanged sleeves for supporting leveling bolts or legs when the raceway channels are used as baseboards.

HODGES, RONALD R.

WELLER, GEORGE V.

UTILITY PANEL SYSTEM

U.S. Pat. No. 5,209,035

A utility panel system is provided for open office spaces, and the like. Each utility panel has a relatively thick, skeleton-like frame, with a foot and opposite sides shaped for interconnection with like panel frames to create a substantially freestanding utility panel system. Cover panels are detachable connected to the opposite faces of each panel frame to enclosure the same, and provide ready access to the panel interior. Horizontal utility troughs extend continuously between the opposite sides of each panel frame in a vertically stacked relationship. The utility troughs have open ends located at the opposite panel sides, and are positioned such that when adjacent utility panels are interconnected in a side-by-side relationship, the utility troughs are aligned to form multiple raceways. Panel connectors are provided to connect the utility panels with one or more of a variety of existing partition panels, such that the utility panels act as a spine which supplies utilities to the existing partition panels.

CLEMENT, CHARLES E.

COMPRESSION FRAMING SYSTEM

U.S. Pat. No. 5,214,893

A modular system of structural framing in which a multiplicity of pre-stressed compression frame modules are combined into frameworks of any required size by use of common connecting means such as plates and brackets. Each compression frame module comprises a plurality of framing members forming a polygonal frame, and a loop means longitudinally encircling the frame. Tension is applied to the loop. The ends of the framing members are shaped to provide non-invasive means for engaging and joining abutting framing members. The tensioned loop serves as the single fastener holding the module together while simultaneously pre-stressing the module by putting it into compression, thereby achieving a synergistic strength. Additionally, separate non-invasive joints and a removable double cam clamping device are provided to improve the functionality of the system and to facilitate use of interchangeable parts.

ROSA, JESUS R.

CORNER CLIP FOR FRAME MEMBERS

OF SCREEN DOORS AND THE LIKE

U.S. Pat. No. 5,297,891

A U-shaped corner clip for use with mitered corners of first and second hollow frame members. One leg of the clip has a hook to engage an opening in the outer edge of a first frame member. The other leg is insertable through an opening in the second frame member but has a length such that is passes from the interior of the second frame member into the interior of the first frame member and there resiliently bears on the inner face of the inner edge of the other frame member. Thus, any force tending to rotate the frame members apart in a direction to increase the angle therebetween is resisted by the action of the second leg member on the first frame member. The clip also resists any force tending to move the frame members linerally away from each other in any direction.

GUILLEMET, GUY

CORNER ASSEMBLY AND FRAME

COMPRISING SUCH ASSEMBLY

U.S. Pat. No. 5,431,211

A corner assembly and frame comprising such assembly is provided, for holding a screen or the like, in which the corner assembly has a pair of arms disposed to be connected to frame side members, preferably by being telescopically received therein, with a frame generally having such corner assemblies at corners thereof, for facilitating retaining the frame assembly, which is a removable assembly, inside a fixed frame at the periphery of a window. Each corner assembly includes a slide member carried in a slideway, which slide member carries a retaining protrusion extending therefrom, and with the slide member having a manually engageable button, movable button, movable longitudinally, to move the slide member and its protruding button between two positions, one position of which is an extended position for the retaining protrusion, and another position of which is a retracted position therefor. In the extended position of the retaining protrusion, the protrusion is adapted to engage within a recess of a fixed frame member of a window.

SUMMARY OF THE INVENTION

A primary object of the present invention is to provide a knockdown and reassemble office partition that will overcome the shortcomings of the prior art devices.

Another object is to provide a knockdown and reassemble office partition in which the various parts of the office partition can be quickly assembled together and then taken apart with bolts, to make it economical to be transported and set up in an office.

An additional object is to provide a knockdown and reassemble office partition in which special partition connectors are used to connect at least two office partitions together to form a work area in the office.

A further object is to provide a knockdown and reassemble office partition that is simple and easy to use.

A still further object is to provide a knockdown and reassemble office partition that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a perspective view of a portion of the framework showing one panel and the top cap exploded therefrom.

FIG. 4 is a perspective view taken in the direction of arrow 4 in FIG. 3, showing one end cover exploded therefrom.

FIG. 5 is a top view taken in the direction of arrow 5 in FIG. 3, with the top horizontal frame member broken away.

FIG. 6 is a cross sectional view taken along line 6—6 in FIG. 5.

Similar reference characters denote corresponding features consistently throughout the attached drawings.

DETAILED DESCRIPTION OF THE PREFERRED EMBODIMENTS

Figure 1:
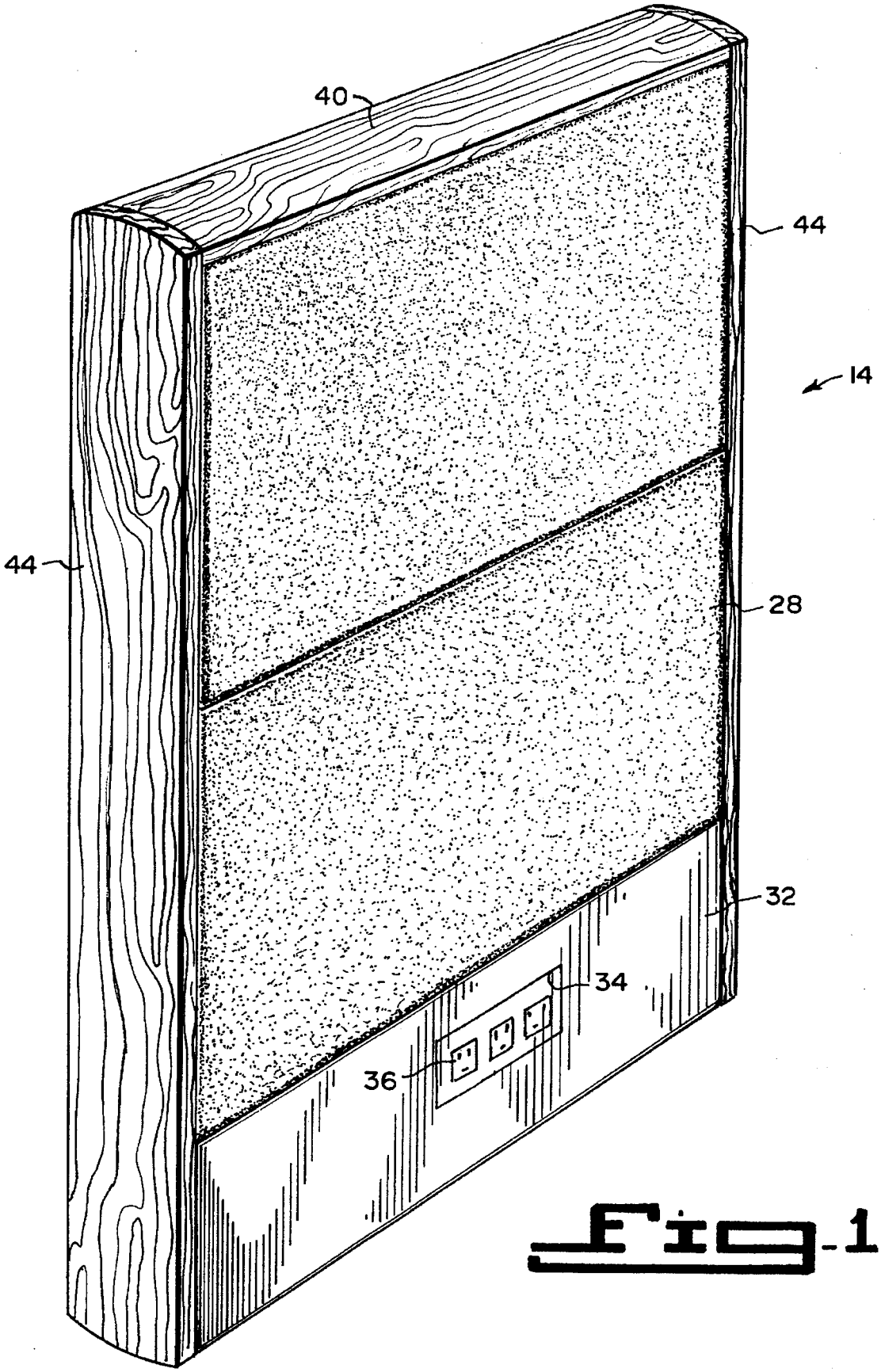
FIG. 1 is a perspective view of one office partition completely assembled.
Figure 1A:
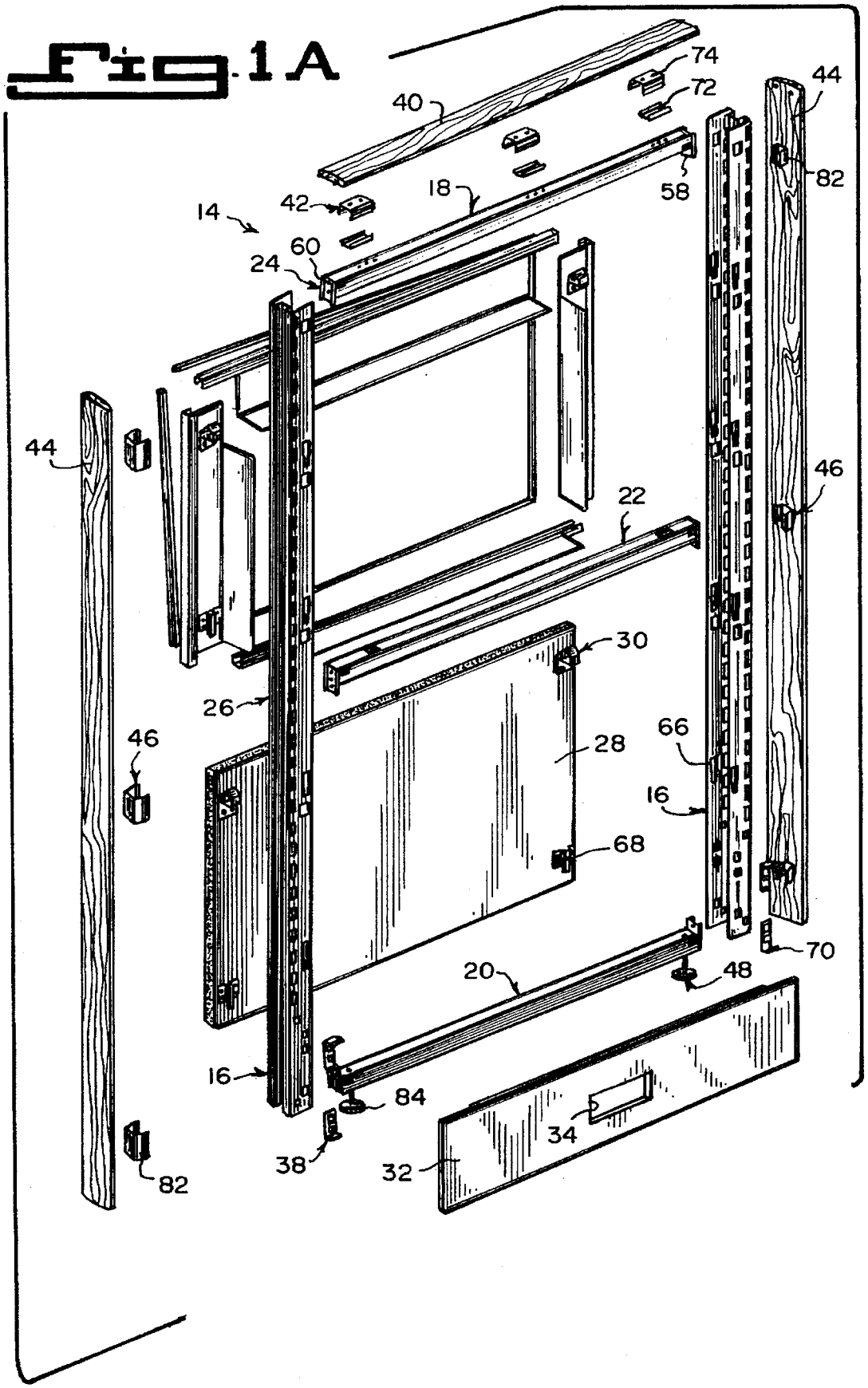
FIG. 1A is an exploded perspective view showing the various components of the office partition in a disassembled condition.
Figure 2:
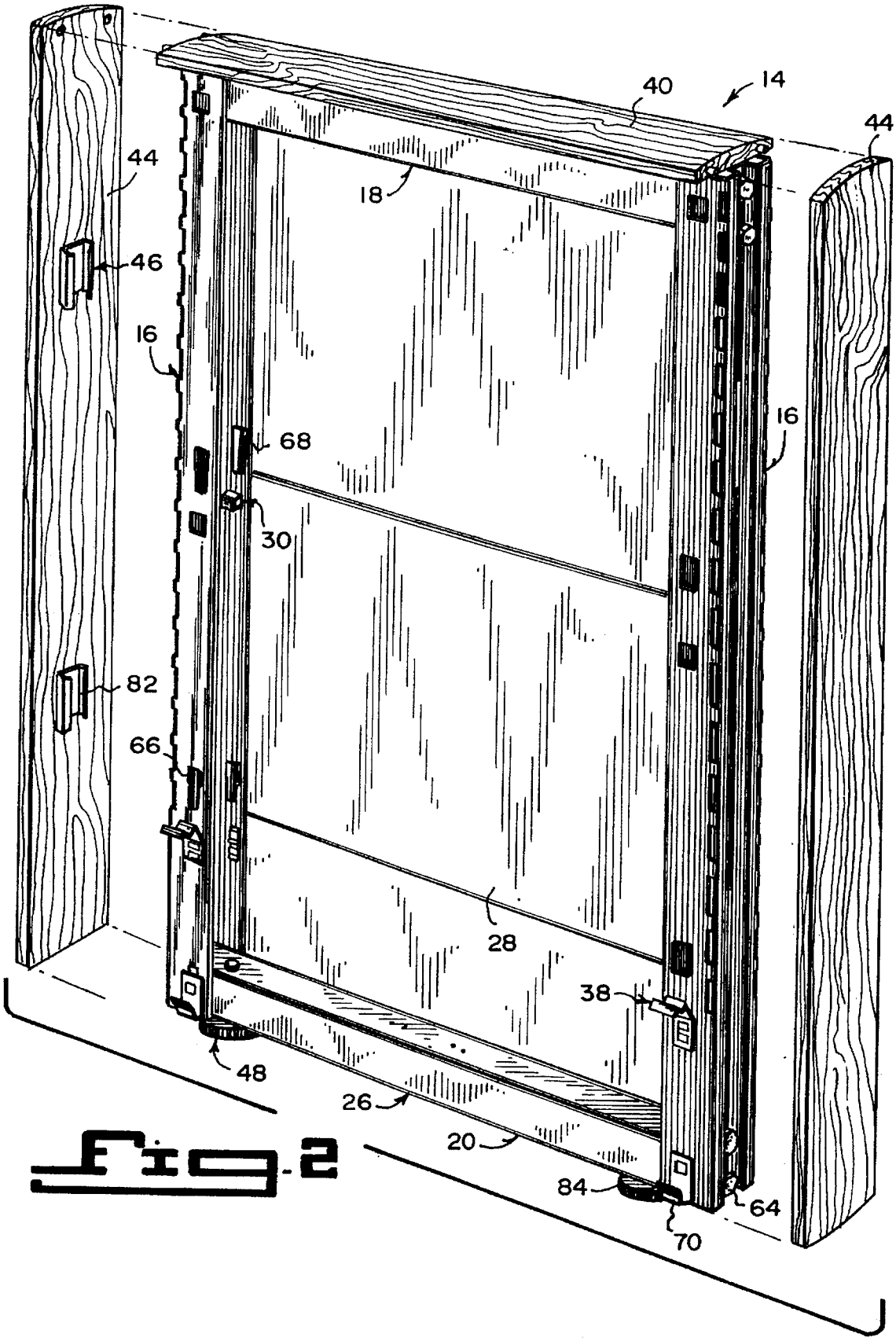
FIG. 2 is a perspective view of the office partition with some components removed and the end covers exploded therefrom.
Figure 7:
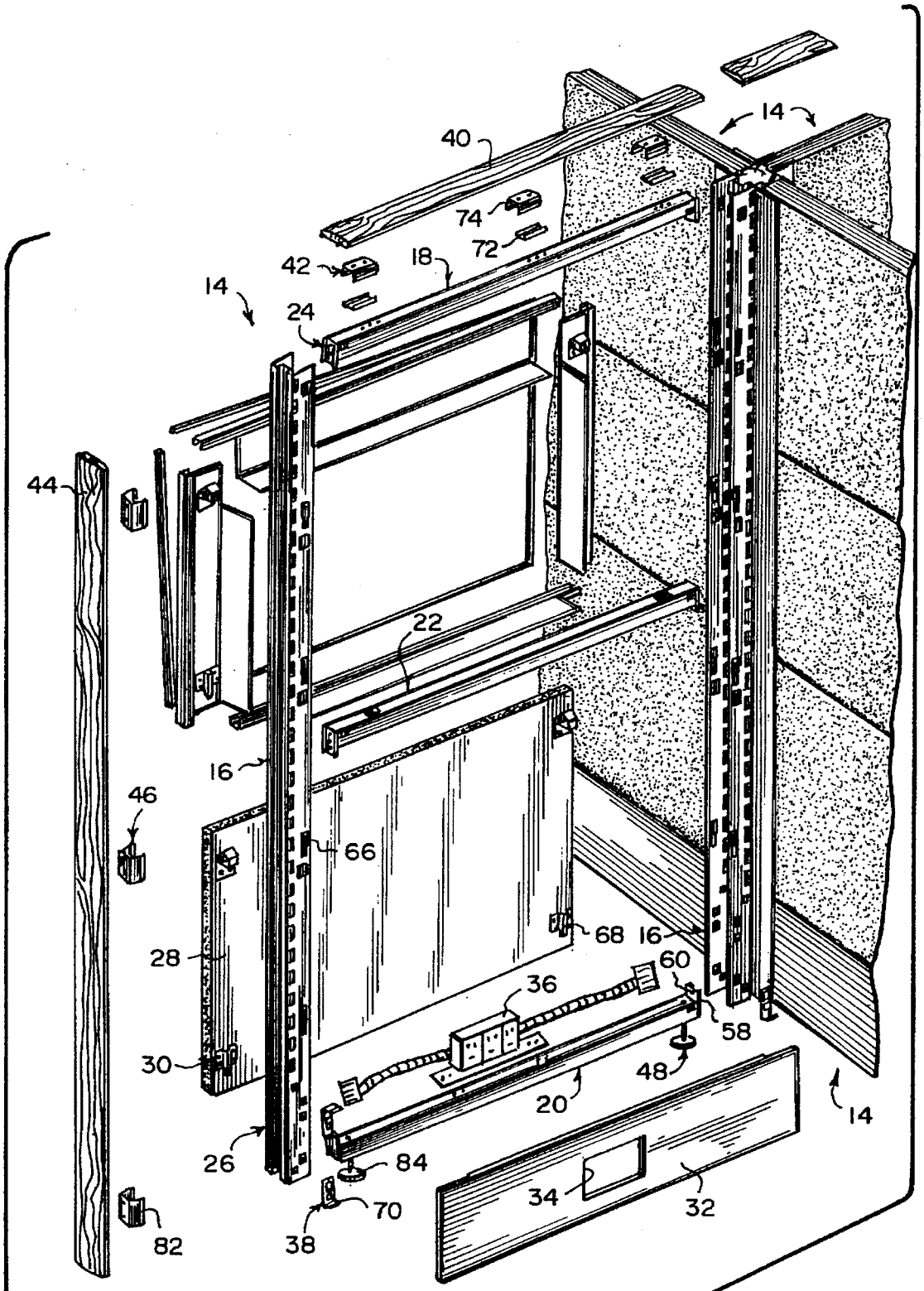
FIG. 7 is an exploded perspective view similar to FIG. 1A, showing the right side vertical frame member of the office partition connected to three other office partitions which are broken away.

Turning now descriptively to the drawings, in which similar reference characters denote similar elements throughout the several views, FIGS. 1 through 12 illustrate a knockdown and reassemble office partition 14 which comprises a pair of side frame members 16, a top frame member 18, a bottom frame member 20 and an intermediate frame member 22. A facility 24 is for securing in a removable manner each of the side frame members 16 vertically to one end of the top frame member 18, the bottom frame member 20 and the intermediate frame member 22 which are positioned horizontally, so as to form a rigid structural framework 26.

A plurality of panels 28 are provided. Components 30 are for mounting each of the panels 26 in a removable manner to the side frame members 16, so as to conceal the rigid structural framework 26.

A raceway cover 32 has an aperture 34 therethrough for an electrical outlet 36. Elements 38 are for attaching the raceway cover 32 in a removable manner to one outer face on both of the side frame members 16 below the lowermost panel 28, so as to conceal the wiring of the electrical outlet 36 within a raceway location in the rigid structural framework 26.

A top cap 40 is provided. Equipment 42 is for affixing in a removable manner the top cap 40 to the top frame member 18, so as to conceal the top frame member 18. A pair of side covers 44 are provided. Items 46, for fastening in a removable manner each of the side cover 44 to one side frame 16, so as to conceal the side frame members 16.

An assembly 48 is for leveling the bottom frame member 20 on a floor 50, so that the rigid structural framework 26 can stand in an upright position on the floor 50. Articles 52 are for joining the abutting side frame members 16 of at least two office partitions 14 together in a removable manner, so that at least two office partitions 14 will form a work area 54 in an office 56.

The side frame member securing facility 24 includes a plurality of brackets 58. Each bracket 58 has two holes 60 therethrough attached to opposite ends of the top frame member 18, the bottom frame member 20 and the intermediate frame member 22. The pair of side frame members 16 have a plurality of apertures 62 in end faces therethrough, which align with the holes 60 in the brackets 58. A plurality of bolts 64 extend through the apertures 62 in the end faces of the side frame members 16 and into the holes 60 in the brackets 58.

The panel mounting component 30 consists of the pair of side frame members 16 having a plurality of openings 66 in outer faces therethrough. Each of the panels 28 have four panel clips 68. Each panel clip 68 is located at one corner of the panel 68. The panel clips 68 can snap into respective openings 66 in the pair of side frame members 16.

The raceway cover attaching elements 38 are four raceway clips 70. Two of the raceway clips 70 are affixed to each bottom end of one outer face on the side frame members 16. The raceway cover 32 can snap into place on the raceway clips 70.

The top cap affixing equipment 42, as shown in FIGS. 1A, 7, 8 and 12 contains a plurality of mounting clips 72 attached onto the top frame member 18. A plurality of top cap clips 74 are attached to an inner surface of the top cap 40. The top cap clips 74 can snap onto the respective mounting clips 72.

The top cap equipment 42, as shown in FIGS. 3, 4 and 5 consists of the top frame member 18 having a plurality of top openings 76 therethrough. A plurality of top cap clips 78 are attached to the underside of the top cap 40. The top cap clips 78 can snap into the respective top openings 76 in the top frame member 18.

The side cover fastening items 46 include each of the side frame members 16 having a plurality of apertures 80 in the end face. A plurality of side cover clips 82 are attached to an inner surface of each side cover 44. The side cover clips 82 can snap into the respective apertures 80 in the end faces of the side frame members 16.

The bottom frame member leveling assembly 48 consists of a plurality of adjustable feet 84 threaded into a bottom surface of the bottom frame member 20, to adjust the height thereof. The joining articles 52 are a plurality of special partition connectors 86. A plurality of bolts 88 are for attaching the special partition connectors 86 to the abutting side frame members 16.

Figure 8:
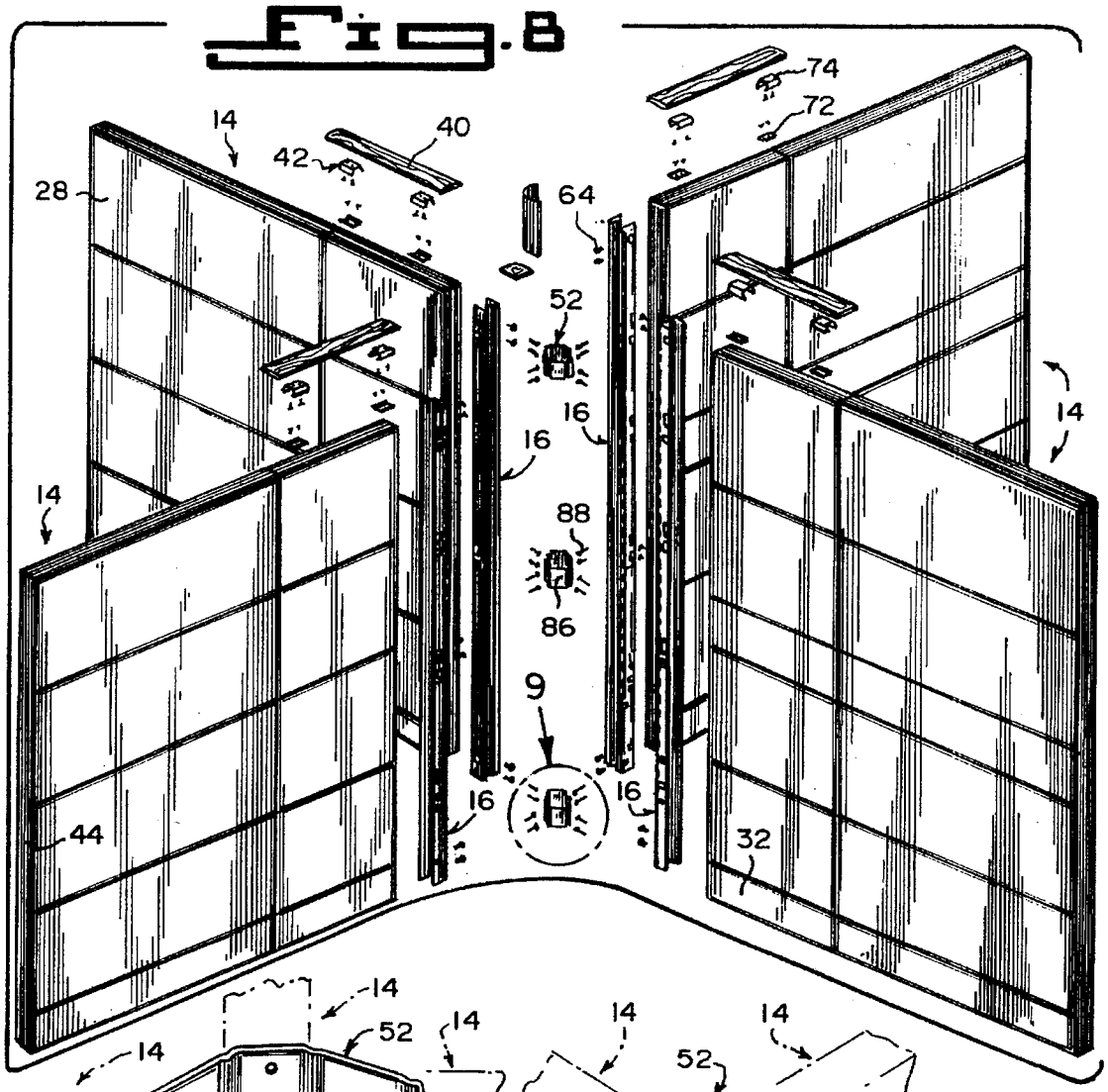
FIG. 8 is a perspective view showing four office partitions in partially disassembled conditions that are rigidly held together by special partition connectors.
Figure 9:
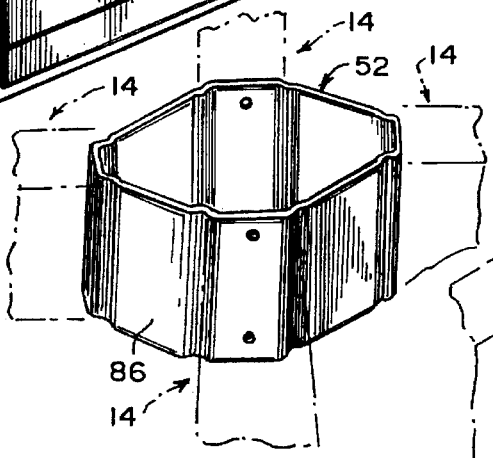
FIG. 9 is an enlarged perspective view of one special partition connector as indicated by arrow 9 in FIG. 8, for holding four office partitions together in a "X" configuration.
Figure 10:
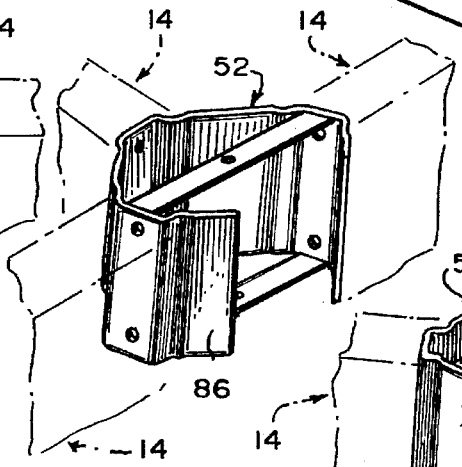
FIG. 10 is an enlarged perspective view similar to FIG. 9 of one special partition connector used for holding three office partitions together in a "T" configuration.
Figure 11:
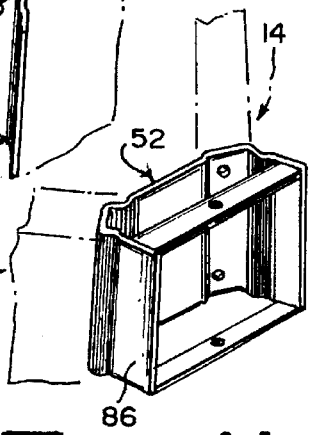
FIG. 11 is an enlarged perspective view similar to FIG. 9 of one special partition connector used for holding two office partitions together in a "V" configuration.
Figure 12:
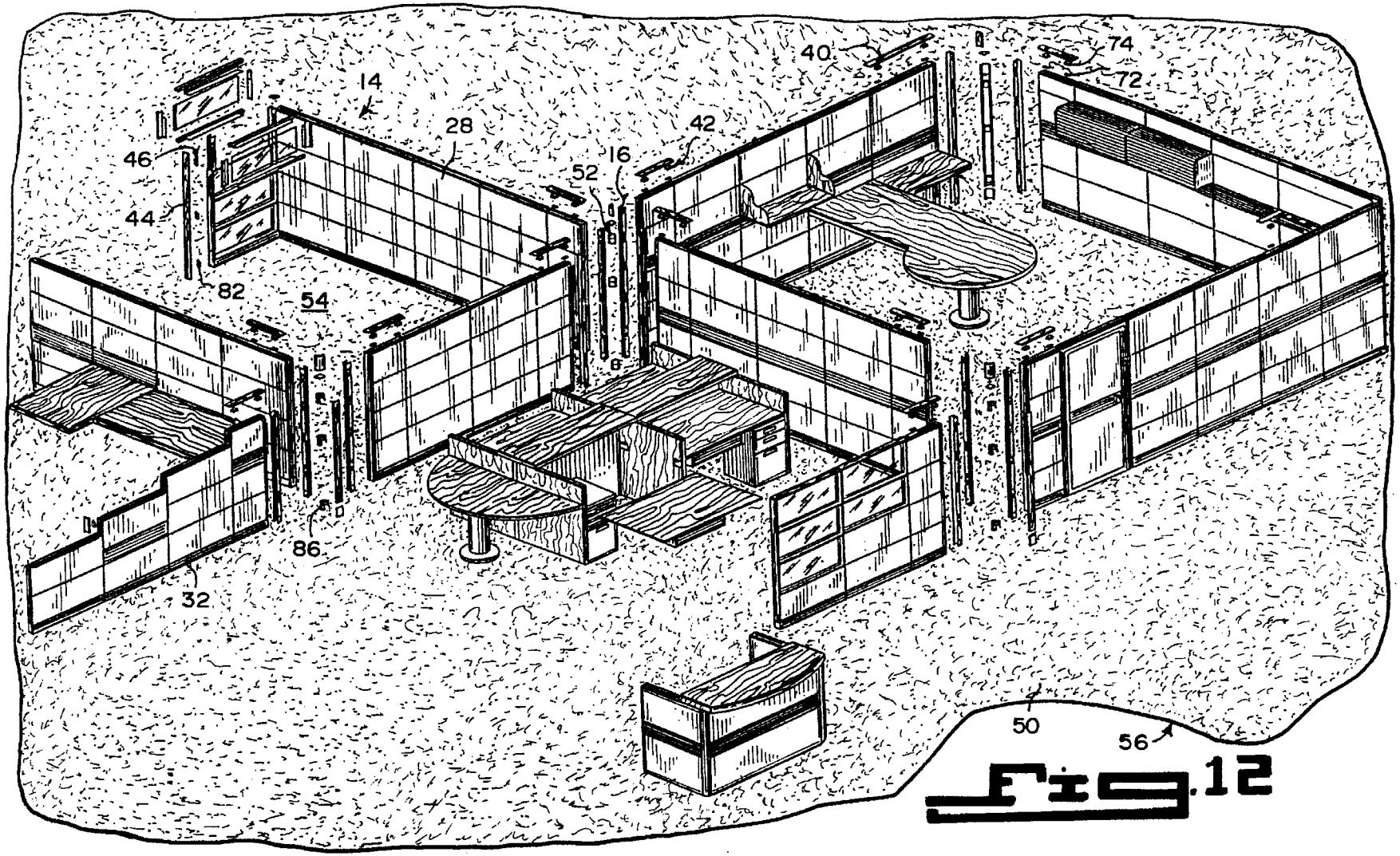
FIG. 12 is perspective view of an office showing office partitions in partially disassembled conditions which form work areas in the office.

Each special partition connector 86, as shown in FIGS. 8, 9 and 12, is of the type for holding four office partitions 14 together in an "X" configuration. Each special partition connector 86, as shown in FIG. 10, is of the type for holding three office partitions 14 together in a "T" configuration. Each special partition connector 86, as shown in FIG. 11, is of the type for holding two office partitions 14 together in a "V" configuration.

LIST OF REFERENCE NUMBERS

14 knockdown and reassemble office partition
16 side frame member of 14
18 top frame member of 14
20 bottom frame member of 14
22 intermediate frame member of 14
24 side frame member securing facility of 14
26 rigid structural framework of 14
28 panel of 14
30 panel mounting component
32 raceway cover of 14
34 aperture in 32
36 electrical outlet
38 raceway cover attaching element
40 top cap
42 top cap affixing equipment
44 side cover
46 side cover fastening item
48 bottom frame member leveling assembly
50 floor
52 joining articles
54 work area
56 office
58 bracket of 24
60 hole in 58
62 aperture in 16
64 bolt of 24
66 opening in 16
68 panel clip of 30
70 raceway clip of 38
72 mounting clip of 42 on 18
74 top cap clip of 42 on 40
76 top opening in 18
78 top cap clip of 42 on 40
89 aperture in 16
82 side cover clip of 46
84 adjustable foot of 48
86 special partition connector for 52
88 bolt of 52

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A knockdown and reassemble office partition which comprises:

a) a pair of side frame members;

b) a top frame member;

c) a bottom frame member;

d) an intermediate frame member;

e) means for securing in a removable manner each of said side frame members vertically to one end of said top frame member, said bottom frame member and said intermediate frame member which are positioned horizontally, so as to form a rigid structural framework comprising a plurality of brackets in which each said bracket having two holes therethrough is attached to opposite ends of said top frame member, said bottom frame member and said intermediate frame member, said pair of side frame members having a plurality of apertures in end faces therethrough which align with said holes in said brackets, and a plurality of bolts to extend through said apertures in said end faces of said side frame members and into said holes in said brackets;

f) a plurality of panels and means for mounting each of said panels in a removable manner to said side frame members to conceal said rigid structural framework, said pair of side frame members having a plurality of Openings in outer faces therethrough and each of said panels having panel clips, a panel clip being located at each corner of said panel so that said panel clips snap into respective openings in said pair of side frame members;

g) a raceway cover and an aperture therethrough for an electrical outlet and means for attaching said raceway cover in a removable manner to one outer face on both of said side frame members below said lowermost panel to conceal the wiring of the electrical outlet with a raceway location in said rigid structural framework, said raceway cover attaching means including raceway clips in which two of said raceway clips are affixed to each bottom end of said one outer face on said frame members so that said raceway cover snaps into place on said raceway clips;

h) a top cap and means for affixing in a removable manner said top cap to said top frame member to conceal said top frame member comprising said top frame member having a plurality of top openings therethrough and a plurality of top cap clips attached to the underside of said top cap in which said top cap clips snap into said respective top openings in said top frame member;

i) a pair of side covers and means for fastening in a removable manner each of said side covers to one said side frame member to conceal said side frame members comprising each of said side frame members having a plurality of apertures in said end face and a plurality of side cover clips attached to an inner surface of each said side cover in which said side cover clips can snap into the respective apertures in said end faces of said side frame members;

j) means for leveling said bottom frame member on a floor so that said rigid structural framework can stand in an upright position on the floor comprising a plurality of adjustable feet threaded into a bottom surface of said bottom frame member to adjust the height thereof; and k) means for joining abutting side frame members of adjacent office partitions together in a removable manner so that at least two said office partitions form a work area in an office comprising a plate bent to form flat surfaces arranged to connect to a plurality of said abutting side frame members.

* * * * *